US011149499B1

(12) United States Patent
Batarseh

(10) Patent No.: US 11,149,499 B1
(45) Date of Patent: Oct. 19, 2021

(54) LASER ARRAY DRILLING TOOL AND RELATED METHODS

(71) Applicant: Saudi Arabian Oil Company, Dhahran (SA)

(72) Inventor: Sameeh Issa Batarseh, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/862,932

(22) Filed: Apr. 30, 2020

(51) Int. Cl.

| | |
|---|---|
| ***E21B 7/15*** | (2006.01) |
| ***E21B 17/10*** | (2006.01) |
| ***E21B 43/11*** | (2006.01) |
| ***E21B 7/14*** | (2006.01) |

(52) U.S. Cl.
CPC ..... *E21B 7/15* (2013.01); *E21B 7/14* (2013.01); *E21B 17/1078* (2013.01); *E21B 43/11* (2013.01)

(58) Field of Classification Search
CPC ... E21B 7/15; E21B 7/046; E21B 7/14; E21B 17/1078; E21B 43/11
See application file for complete search history.

(56) References Cited

U.S. PATENT DOCUMENTS

| | | | | |
|---|---|---|---|---|
| 6,755,262 | B2 | 6/2004 | Parker | |
| 6,888,097 | B2 | 5/2005 | Batarseh | |
| 9,677,339 | B2 | 6/2017 | Linetskiy et al. | |
| 2004/0206505 | A1 | 10/2004 | Batarseh | |
| 2014/0345861 | A1 | 11/2014 | Stalder et al. | |
| 2015/0129203 | A1 | 5/2015 | Deutch et al. | |
| 2015/0198022 | A1 | 7/2015 | Stanecki et al. | |
| 2017/0191314 | A1* | 7/2017 | Faircloth | H01S 3/0941 |
| 2019/0353032 | A1* | 11/2019 | Batarseh | E21B 43/247 |
| 2020/0392793 | A1* | 12/2020 | Batarseh | E21B 43/26 |

FOREIGN PATENT DOCUMENTS

| | | | |
|---|---|---|---|
| CN | 203081295 | U | 7/2013 |
| CN | 203334954 | U | 12/2013 |
| WO | WO-2014/078663 | A2 | 5/2014 |

OTHER PUBLICATIONS

International Search Report for PCT/IB2020/056736, 3 pages (dated Dec. 9, 2020).
Written Opinion for PCT/IB2020/056736, 6 pages (dated Dec. 9, 2020).

* cited by examiner

*Primary Examiner* — Yong-Suk (Philip) Ro
(74) *Attorney, Agent, or Firm* — Choate, Hall & Stewart LLP; Charles E. Lyon; Peter A. Flynn

(57) ABSTRACT

Systems and methods for stimulating hydrocarbon bearing formations include using a downhole laser tool. An example laser perforation tool is for perforating a wellbore in a downhole environment within a hydrocarbon bearing formation. The laser perforation tool includes a plurality of perforation units disposed within an elongated body of the laser perforation tool. Each of the plurality of perforation units includes a laser beam redirection tool coupled to a laser head. The beam redirection tool alters a direction of an output laser beam.

24 Claims, 17 Drawing Sheets

LASER ARRAY DRILLING TOOL AND RELATED METHODS

TECHNICAL FIELD

This application relates to laser tools and related systems and methods for stimulating hydrocarbon bearing formations using high power lasers.

BACKGROUND

Wellbore stimulation is a branch of petroleum engineering focused on ways to enhance the flow of hydrocarbons from a formation to the wellbore for production. To produce hydrocarbons from the targeted formation, the hydrocarbons in the formation need to flow from the formation to the wellbore in order to be produced and flow to the surface. The flow from the formation to the wellbore is carried out by the means of formation permeability. When formation permeability is low, stimulation is applied to enhance the flow. Stimulation can be applied around the wellbore and into the formation to build a network in the formation. The first step for stimulation is commonly perforating the casing and cementing in order to reach the formation. One way to perforate the casing is the use of a shaped charge. Shaped charges are lowered into the wellbore to the target release zone. The release of the shaped charge creates short tunnels that penetrate the steel casing, the cement and the formation.

The use of shaped charges has several disadvantages. For example, shaped charges produce a compact zone around the tunnel, which reduces permeability and therefore production. The high velocity impact of a shaped charge crushes the rock formation and produces very fine particles that plug the pore throat of the formation reducing flow and production. There is the potential for melt to form in the tunnel. There is no control over the geometry and direction of the tunnels created by the shaped charges. There are limits to the penetration depth and diameter of the tunnels. There is a risk involved while handling the explosives at the surface.

The second stage of stimulation typically involves pumping fluids through the tunnels created by the shaped charges. The fluids are pumped at rates exceeding the formation breaking pressure causing the formation and rocks to break and fracture, this is called hydraulic fracturing. Hydraulic fracturing is carried out mostly using water based fluids called hydraulic fracture fluid. The hydraulic fracture fluids can be damaging to the formation, specifically shale rocks. Hydraulic fracturing produces fractures in the formation, creating a network between the formation and the wellbore.

Hydraulic fracturing also has several disadvantages. First, as noted above, hydraulic fracturing can be damaging to the formation. Additionally, there is no control over the direction of the fracture. Fractures have been known to close back up. There are risks on the surface due to the high pressure of the water in the piping. There are also environmental concerns regarding the components added to hydraulic fracturing fluids and the need for the millions of gallons of water required for hydraulic fracturing.

High power laser systems can also be used in a downhole application for stimulating the formation via, for example, laser drilling a clean, controlled hole. Laser drilling typically saves time because laser drilling does not require pipe connections like conventional drilling, and is an environmentally friendly technology with lower emissions compared to conventional drilling, as the laser is electrically powered. However, there are still limitations regarding the placement and maneuverability of a laser tool for effective downhole use.

SUMMARY

Conventional methods for drilling holes in a formation have been consistent in the use of mechanical force by rotating a bit. Problems with this method include damage to the formation, damage to the bit, and the difficulty to steer the drilling assembly with accuracy. Moreover, drilling through a hard formation has proven very difficult, slow, and expensive. However, the current state of the art in laser technology can be used to tackle these challenges. Generally, because a laser provides thermal input, it will break the bonds and cementation between particles and simply push them out of the way. Drilling through a hard formation will be easy and fast, in part, because the disclosed methods and systems will eliminate the need to pull out of the wellbore to replace the drill bit after wearing out and can go through any formation regardless of its compressive strength.

The present disclosure relates to tools and methods for drilling a hole(s) in a subsurface formation utilizing high power laser energy (for example, greater than 1 kW). In particular, various embodiments of the disclosed tools and methods use a high power laser(s) with a laser source (generator) located on the ground, typically in the vicinity of a wellbore, with the power conveyed via optical transmission media, such as fiber optic cables, down the wellbore to a downhole target via a laser tool. Generally, the tool described in this application can drill, perforate, and orient itself in any direction.

An example laser perforation tool is for perforating a wellbore in a downhole environment within a hydrocarbon bearing formation. The laser perforation tool includes a plurality of perforation units disposed within an elongated body of the laser perforation tool. Each of the plurality of perforation units includes an optical transmission media passing a raw laser beam generated from a laser generator. The optical transmission media extends within an elongated body of the laser perforation tool. Each of the plurality of perforation units includes a laser head receiving the raw laser beam from, and coupled to the optical transmission media. The laser head includes an optical assembly controlling at least one characteristic of an output laser beam. Each of the plurality of perforation units includes a beam redirection tool coupled to the laser head. The beam redirection tool alters a direction of the output laser beam.

The beam redirection tool may include a prism, mirror, reflector, or a combination thereof. The laser perforation tool may generates two or more output laser beams, the two or more output laser beams propagating in at least two different directions. At least two of the two or more output laser beams may not be parallel to each other. At least two of the two or more output laser beams may cross each other.

The laser perforation tool may create at least two perforations in the wellbore, and the at least two perforation may not be parallel to each other. The at least two perforations may cross each other.

The elongated body may extend vertically within the wellbore. The laser perforation tool may create one or more perforations in the wellbore, and the one or more perforations may drain a hydrocarbon by gravitational force. The laser perforation tool may create one or more perforations in the wellbore, and the one or more perforations may drain a hydrocarbon by capillary force.

The laser perforation tool may create one or more perforations in the wellbore, and at least one of the one or more perforations may drain a hydrocarbon by gravitational force, and at least one of the one or more perforations may drain a hydrocarbon by capillary force.

The laser perforation tool may include a plurality of orientation nozzles disposed about an outer circumference of the laser head. The plurality of orientation nozzles may control motion and orientation of the laser head within the wellbore. The plurality of orientation nozzles may provide forward, reverse, or rotational motion to the laser head within the wellbore.

The laser perforation tool may include a purging assembly disposed at least partially within or adjacent to the laser head. The purging assembly may deliver a purging fluid to an area proximate the output laser beam.

The optical assembly may include one or more lenses. The optical assembly may include a first lens focusing the raw laser beam and a second lens shaping the output laser beam. A distance between the first lens and the second lens may be adjustable to control a size of the output laser beam.

The purging assembly may include purging nozzles. At least a portion of the purging nozzles may be vacuum nozzles connected to a vacuum source, and the purging nozzles may remove debris and/or gaseous fluids from the area proximate the output laser beam when vacuum is applied. The plurality of orientation nozzles may be purging nozzles providing thrust to the laser head for movement within the wellbore. The plurality of orientation nozzles may be movably coupled to the laser head thereby allowing the orientation nozzles to rotate or pivot relative to the laser head. The plurality of orientation nozzles may provide forward motion, reverse motion, rotational motion, or combinations thereof to the laser head relative to the tool.

The laser perforation tool may include a centralizer coupled to the laser perforation tool. The centralizer may hold the laser perforation tool in the wellbore. The laser perforation tool may include a plurality of centralizers disposed on the elongated body. A first portion of the plurality of centralizers may be disposed forward of the plurality of perforation units and a second portion of the plurality of centralizers may be disposed aft of the plurality of perforation units.

The laser head may be a distal portion of a tubing unit disposed within the elongated body and deployable from the elongated body.

An example method of using a laser perforation tool includes positioning the laser perforation tool within a wellbore within a hydrocarbon bearing formation. The laser perforation tool includes a plurality of perforation units disposed therein. Each of the plurality of perforation units includes an optical transmission media within an elongated body of the laser perforation tool. Each of the plurality of perforation units includes a laser head coupled to the optical transmission media, wherein the laser head comprises an optical assembly controlling at least one characteristic of an output laser beam. Each of the plurality of perforation units includes a beam redirection tool coupled to the laser head for altering a direction of the output laser beam. The method includes passing, through one or more optical transmission media, at least one raw laser beam generated by a laser generator. The method includes delivering a raw laser beam to each of the optical assemblies. The method includes manipulating the raw laser beams with the optical assemblies to generate output laser beams. The method includes manipulating the direction of the output laser beams with the beam redirection tools. The method includes delivering the output laser beams to the formation.

Definitions

In order for the present disclosure to be more readily understood, certain terms are first defined below. Additional definitions for the following terms and other terms are set forth throughout the specification.

In this application, unless otherwise clear from context, the term "a" may be understood to mean "at least one." As used in this application, the term "or" may be understood to mean "and/or." In this application, the terms "comprising" and "including" may be understood to encompass itemized components or steps whether presented by themselves or together with one or more additional components or steps. As used in this application, the term "comprise" and variations of the term, such as "comprising" and "comprises," are not intended to exclude other additives, components, integers or steps.

About, Approximately: as used herein, the terms "about" and "approximately" are used as equivalents. Unless otherwise stated, the terms "about" and "approximately" may be understood to permit standard variation as would be understood by those of ordinary skill in the art. Where ranges are provided herein, the endpoints are included. Any numerals used in this application with or without about/approximately are meant to cover any normal fluctuations appreciated by one of ordinary skill in the relevant art. In some embodiments, the term "approximately" or "about" refers to a range of values that fall within 25%, 20%, 19%, 18%, 17%, 16%, 15%, 14%, 13%, 12%, 11%, 10%, 9%, 8%, 7%, 6%, 5%, 4%, 3%, 2%, 1%, or less in either direction (greater than or less than) of the stated reference value unless otherwise stated or otherwise evident from the context (except where such number would exceed 100% of a possible value).

In the vicinity of a wellbore: As used in this application, the term "in the vicinity of a wellbore" refers to an area of a rock formation in or around a wellbore. In some embodiments, "in the vicinity of a wellbore" refers to the surface area adjacent the opening of the wellbore and can be, for example, a distance that is less than 35 meters (m) from a wellbore (for example, less than 30, less than 25, less than 20, less than 15, less than 10 or less than 5 meters from a wellbore).

Substantially: As used herein, the term "substantially" refers to the qualitative condition of exhibiting total or near-total extent or degree of a characteristic or property of interest.

Circumference: As used herein, the term "circumference" refers to an outer boundary or perimeter of an object regardless of its shape, for example, whether it is round, oval, rectangular or combinations thereof.

These and other objects, along with advantages and features of the disclosed systems and methods, will become apparent through reference to the following description and the accompanying drawings. Furthermore, it is to be understood that the features of the various embodiments described are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the disclosed systems and methods and are not intended as limiting. For purposes of clarity, not every component may be labeled in every drawing. In the following description, various embodiments are described with reference to the following drawings, in which.

DETAILED DESCRIPTION

Figure 1:
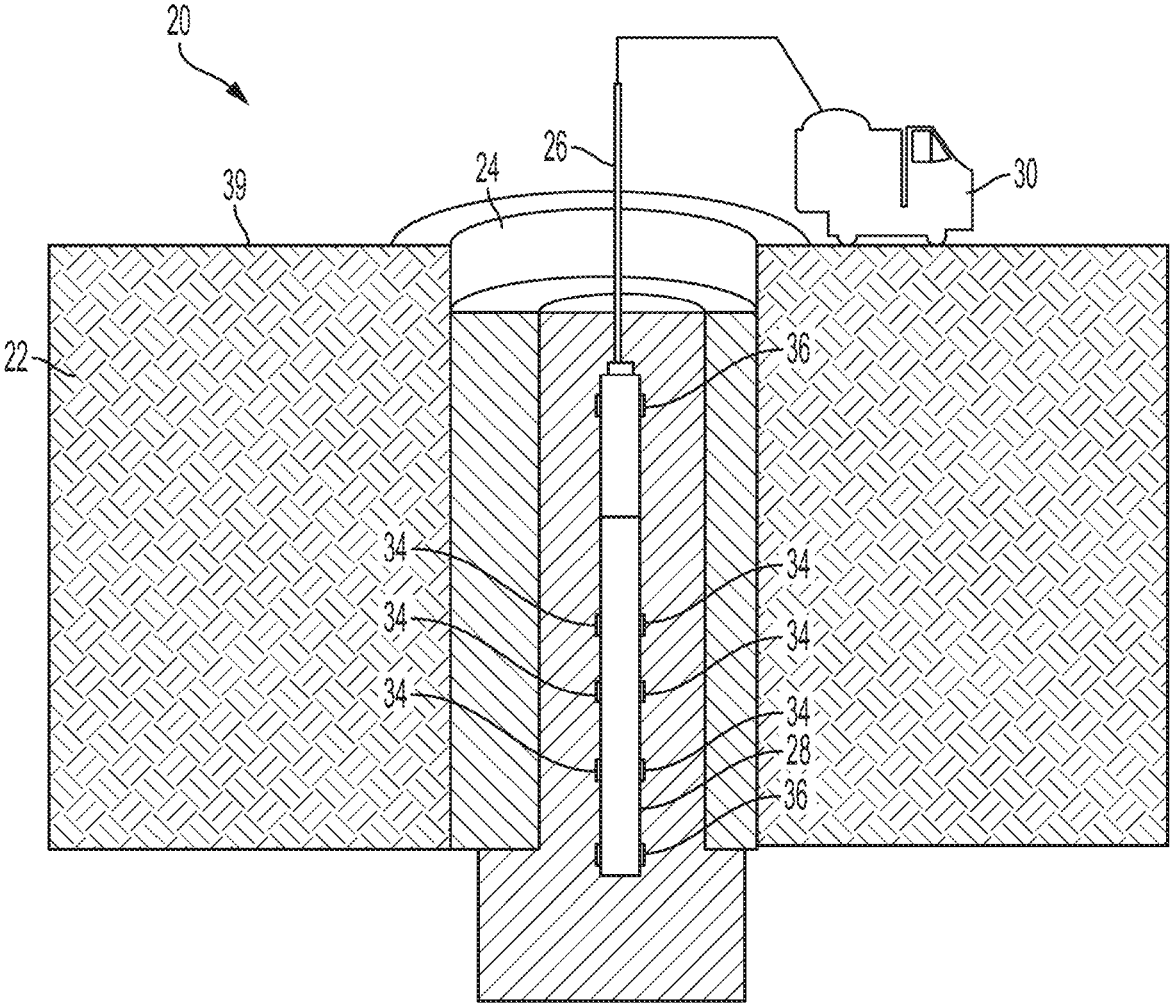
FIG. 1 is a schematic representation of a laser tool disposed within a wellbore in accordance with one or more embodiments.

FIG. 1 depicts a portion of a laser perforation tool 20 that is configured to be lowered downhole via any service provider using a coiled tube unit, wireline, or tractors as known in the art. The laser perforation tool 20 includes an elongated body 28 that houses a plurality of perforation units 32 (see FIG. 2) and defines a series of exit ports 34 disposed about the circumference of the elongated body 28 to allow the perforation units 32 to be deployed into a wellbore 24 of the formation 22. The laser perforation tool 20 also includes centralizers 36 for holding the laser perforation tool 20 in position within the wellbore 24 and to isolate a zone if needed to perform a specific task in that zone upon reaching a target. The perforation units 32 are described in greater detail with respect to FIGS. 2-7.

The centralizers 36 can be disposed at various points along the elongated body 28 as need to suit a particular application. The centralizers 36 can also help support the weight of the laser perforation tool 20 and can be spaced along the elongated body 28 as needed to accommodate the laser perforation tool 20 extending deeper into the formation. The centralizers 36 may include an elastomeric material that expands when wet, bladders that inflates hydraulically or pneumatically from the ground, or by other mechanical means.

As further shown in FIG. 1, the laser perforation tool 20 is coupled to a laser generator 30 disposed on the ground 39 in a vicinity of the wellbore 24 via a cable 26. The cable 26 can include the optical transmission media (for example, fiber optics), along with any power or fluid lines as needed to operate the laser perforation tool 20. The cable 26 extends from a laser generator 30 to the plurality of perforation units 32 disposed within the elongated body 28.

Figure 2:
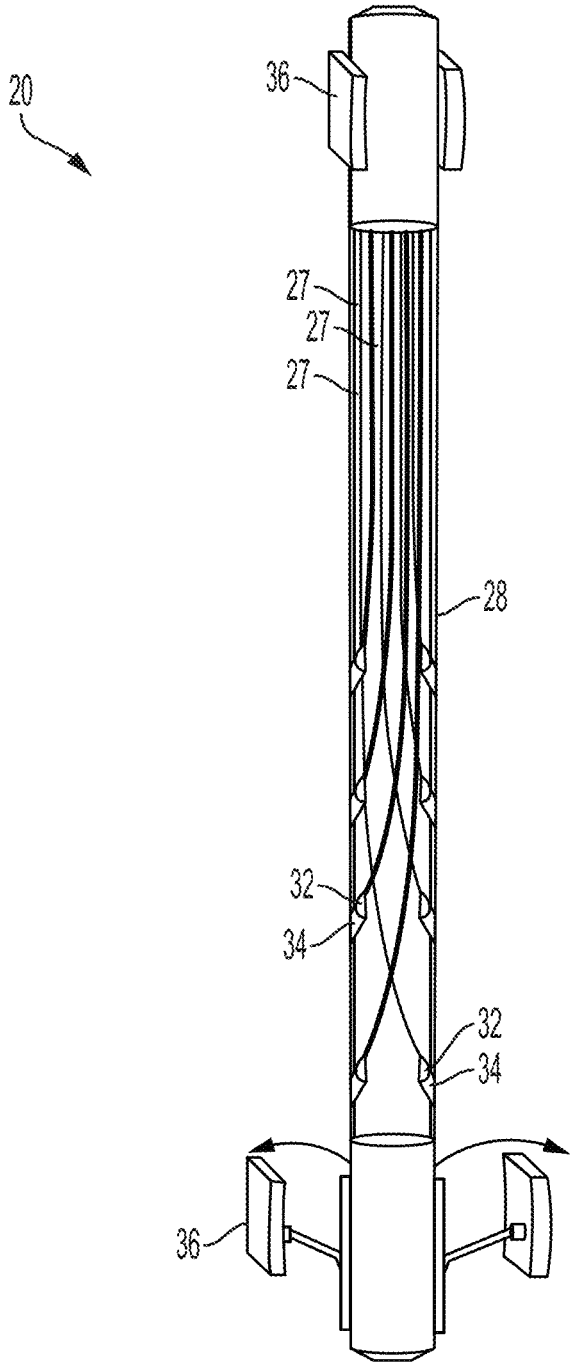
FIG. 2 is a schematic representation of the laser tool depicted in FIG. 1 in accordance with one or more embodiments.
Figure 8:
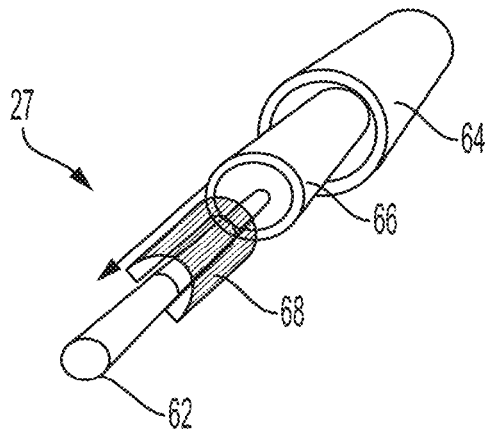
FIG. 8 is a partial, exploded perspective view of fiber optic cable for use in a tool in accordance with one or more embodiments.
Figure 15B:
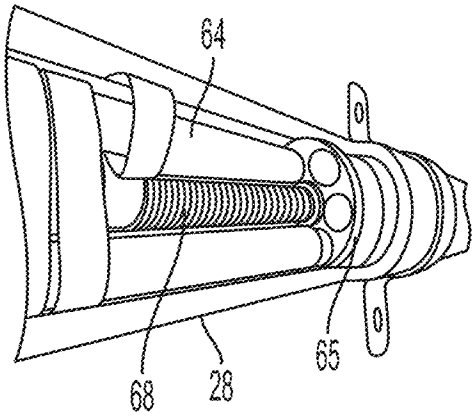
FIGS. 15A and 15B are pictorial representations of a method of bundling and deploying cable arrays.
Figure 15A:
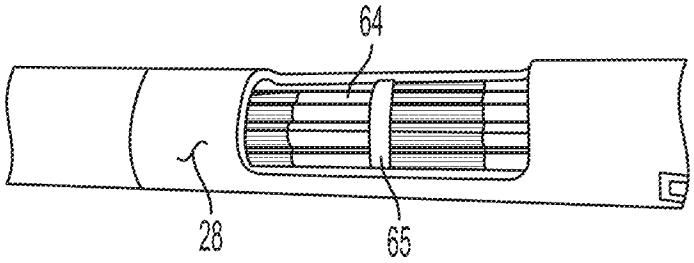

FIG. 2 depicts one embodiment of the laser perforation tool 20 in a partial cross-section to better illustrate the perforation unit 32. The laser perforation tool 20 houses bundles or arrays of perforation units 32, each one of which includes a fiber optic cable 27 (or optical transmission media) for coupling a laser head 38 (see FIG. 3) to the laser generator 30. The energy from the laser generator 30 is transmitted to the laser perforation tool 20, specifically each individual perforation units 32, via the fiber optic cables 27, which are shielded as shown in FIG. 8, to protect the fiber optic cables 27 from the downhole environment. The fiber optic cables 27 may be bundled within the laser perforation tool 20 in accordance with the same means as used for different materials/applications in the industry. FIGS. 15A and 15B provide pictorial images of a commonly used bundle arrangement for illustrative purposes. As can be seen in FIGS. 15A and 15B, a portion of the elongated body 28 is cut-away to show a bundle of casings 64 secured in a deployable manner within the elongated body 28. Each casing 64 houses at least one fiber optic cable 27. In some embodiments, the casings 64 may be aligned or secured within the elongated body 28 by one or more jigs 65 or other structure to hold the casing in position and guide its deployment.

FIG. 8 depicts one example of an internal configuration of a fiber optic cable 27 that can be shielded with a hard or flexible case. In both types, the optical fiber 62 must be protected from high temperature, pressure, and downhole conditions such as fluids, hydrogen gases, stress, vibration, etc. As shown, the fiber optic cable 27, includes an outer shield of a high temperature/pressure resistant casing 64, then a high temperature/pressure resistant insolation cable 66 to maintain a temperature of the fiber optics cable, as high temperature will damage the cable, then a protective cable 68, which typically comes with the fiber optics manufacturer, and then the optical fiber 62 to deliver the laser beam from the laser generator 30.

Figure 11:
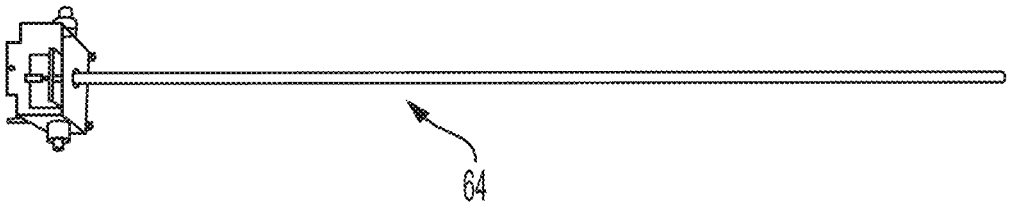
FIG. 11 is a pictorial representation of a rigid perforation means for use in a tool in accordance with one or more embodiments.
Figure 12:
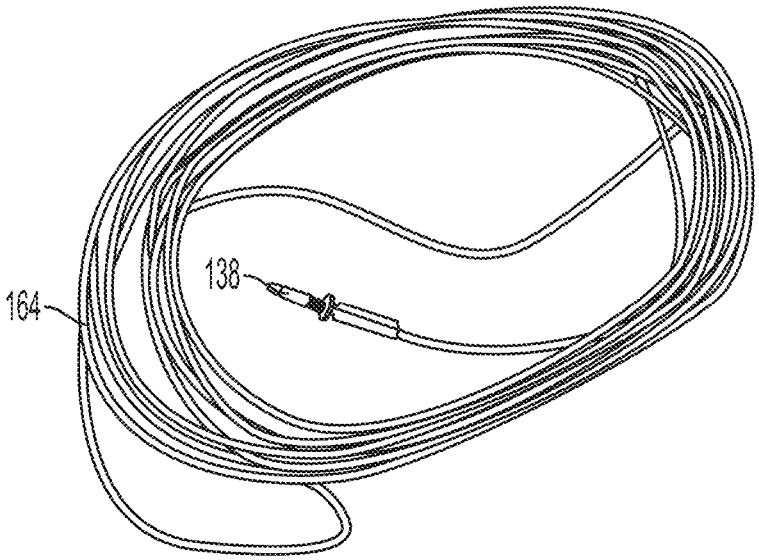
FIG. 12 is a pictorial representation of a flexible perforation means for use in a tool in accordance with one or more embodiments.

Typically, a hard outer casing 64 is made from materials such as stainless steel, or other materials that can be used to penetrate the formation and withstand downhole conditions. An example of an experimental casing made of stainless steel is depicted in FIG. 11. The casing shown in FIG. 11 is rigid and is deployed in a substantially straight line. Alternatively, a flexible casing 164 can be used, such as the one depicted in FIG. 12. For a flexible casing 164, the laser head 138 may include orientation means, such as those to be described later, to direct the cable 26 into the formation.

Referring back to FIG. 2, the laser perforation tool 20 holds the plurality of fiber optic cables 27 as bundles or arrays running longitudinally within the elongated body 28. For example, the laser perforation tool 20 shown includes eight (8) individual fiber optic cables 27; however various embodiments will include different multiples of fiber optic cables 27 as necessary to suit a particular application and may include, for example, two, four, six, ten or more cables or even sets of cables disposed at different positions along the tool body (see FIG. 9). The fiber optic cables 27 are inserted and aligned in the laser perforation tool 20, with the tip (laser heads 38) aligned with the exit ports 34, such that one fiber optic cable 27 is aligned with one exit port 34. When the laser perforation tool 20 reaches the target, the fiber optic cables 27 may be deployed from the elongated body 28. In some embodiments, the fiber optic cables 27 are pushed out of the laser perforation tool 20 via an actuator on the surface acting on at least a portion of the main cable 26. The actuator may be electrically, hydraulically, or pneumatically driven.

In various embodiments, the fiber optic cables 27 may also be deployed by, or the deployment assisted by, the orientation nozzles 44 to be described later. The exit ports 34 shown in FIG. 2 are disposed on diametrically opposed surfaces of a circumference of the elongated body 28; however, the exit ports 34 may be positioned anywhere along the tool body 28 to suit a particular application. For example, in some embodiments, the exit ports may be oriented in a spiral-like pattern where the exit ports 34 are spaced along a length of the elongated body 28 and radially off-set at regular angular intervals, for example, every 30 degrees, or at irregular intervals to suit a particular application. In addition, the laser perforation tool 20 can be centralized by the centralizer pads 36, which may be inflated at a target position to assist that the laser perforation tool 20 is in the center of the wellbore and correctly aligned with the target. The laser perforation tool 20 may also be equipped with logging and sensing to identify the target, for example, fiber optic cables, acoustic sensors, or sonic logging.

Figure 3:
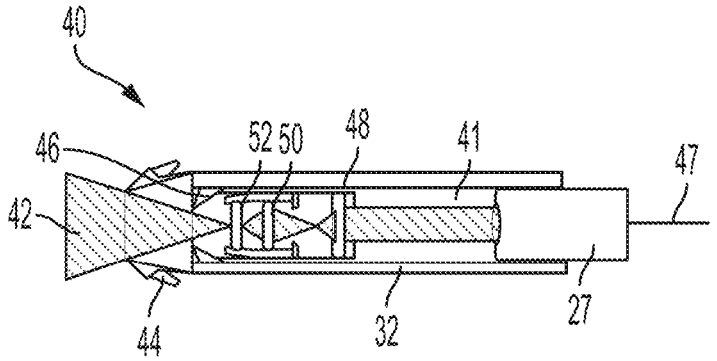
FIG. 3 is a schematic representation of a laser head for use with the laser tool of FIG. 2 in accordance with one or more embodiments.
Figure 4:
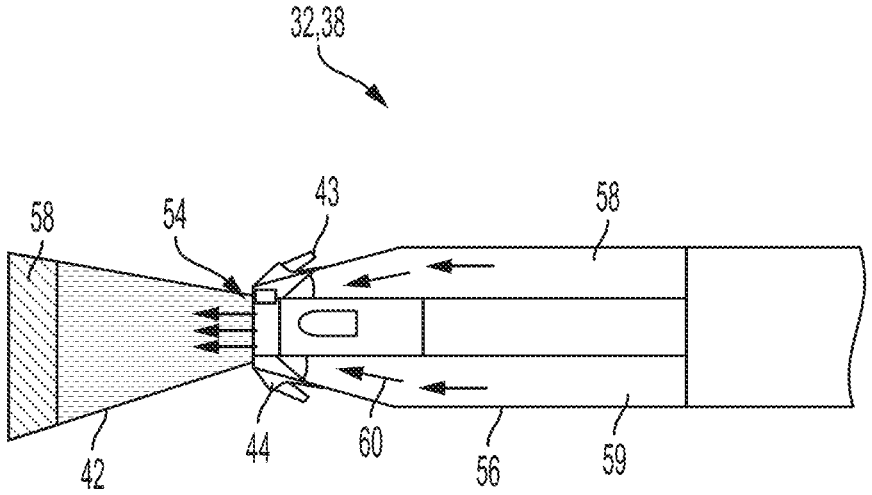
FIG. 4 is another schematic representation of the laser head of FIG. 3 in accordance with one or more embodiments.
Figure 5:
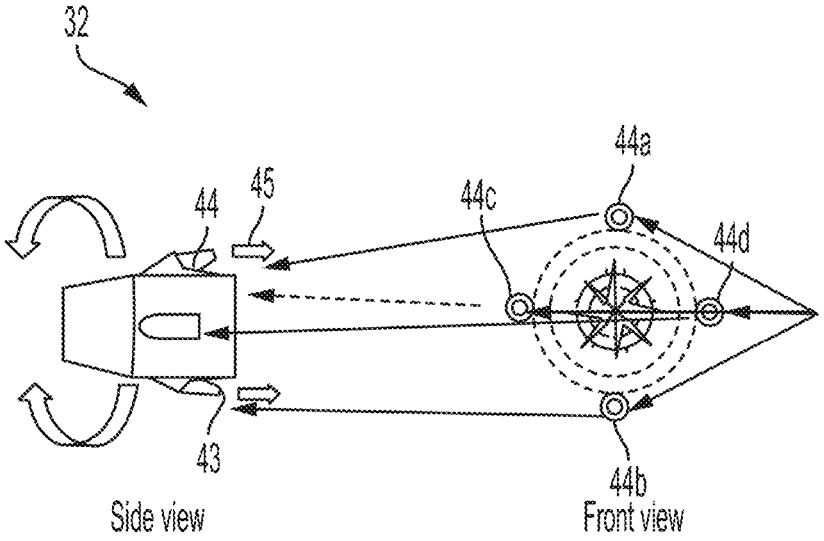
FIG. 5 is a schematic representation of a portion of the laser head of FIG. 3 in accordance with one or more embodiments.

The laser head 38 is depicted in detail in FIGS. 3-5. Referring to FIG. 3, the laser head 38 is shown disposed at a distal end of each fiber optic cable 27 and houses an optical assembly 40 to make up the basic perforation unit 32. In some embodiments, the laser head 38 is a distal portion of the casing 64 in which the fiber optic cable 27 is secured. The laser head 38 may be coupled to the fiber optic cable 27 by any one of various mechanical means known in the art to provide the raw laser beam 41 to the optical assembly 40, which includes one or more lenses as necessary to condition the raw laser beam 41 to suit a particular application.

The optical assembly 40 shown in FIG. 3 includes a first lens 48, a second lens 50, and a cover lens 52. In operation, the raw laser beam 41 enters the laser head 38 and the optical assembly 40 via the first lens 48, which may focus the beam at a point, the beam may then defocus into the second lens 50, which may shape or collimate the beam as necessary to suit a particular application and the size and shape of the beam required. In various embodiments, a distance between the lenses 48, 50 may be adjusted to control the size of the beam. The beam exits the laser head 38 through the cover lens 52 as a shaped laser beam 42.

In addition, and as shown in greater detail in FIGS. 4 and 5, each laser head 38 may also include a plurality of orientation nozzles 44 and a plurality of purging nozzles 46. The purging nozzles 46 are disposed inside the head 38 for cooling the optical assembly and/or preventing any backflow of debris into the head 38. Water or a hydrocarbon fluid, or generally any fluid or gas that is non-damaging and transparent to the laser beam, can be used to remove the debris. The purge fluid 58 can flow through channels 59 disposed within the laser head 38. In accordance with various embodiments, a portion of the purging nozzles 46 may be vacuum nozzles connected to a vacuum source and adapted to remove debris and gaseous fluids from around or within the laser head 38.

The orientation nozzles 44 are located on an outer surface of the laser head 38. In the embodiment shown, there are four (4) orientation nozzles 44 shown disposed on and evenly spaced about an outer circumference of the laser head 38. However, different quantities and arrangements of the orientation nozzles 44 are possible to suit a particular application. For example, if the orientation nozzles 44 are used to assist with deploying the perforation units 32 from the elongated body 28, there may be additional orientation nozzles 44 disposed on the laser head 38.

Generally, the laser head 38 is oriented by controlling a flow of a fluid (either liquid or gas) through the orientation nozzles 44. For example, by directing the flow of the fluid in a rearward direction 45 as shown in FIG. 5, the laser head 38 may be pushed forward in the wellbore by utilizing thrust action, where the openings 43 of the orientation nozzles 44 are facing the opposite directions of the laser head 38 and the fluid flows backward providing the thrust force moving the perforation unit 32 forward. Controlling the flow rate may control the speed of the perforation unit 32 within the wellbore. The fluid for providing the thrust may be supplied from the ground 39 and delivered by a fluid line included within the cable 26.

As shown in FIG. 5, there are four (4) orientation nozzles 44*a*, 44*b*, 44*c*, 44*d* evenly spaced around the laser head 38. Each orientation nozzle 44 flows a fluid to allow to the laser head 38 to move and can be separately controlled. For example, if orientation nozzle 44*a* is the only orientation nozzle on, then the laser head 38 may turn in the south direction, the turn degree depends on the controlled flow rate from that orientation nozzle 44*a*. If all of the orientation nozzles 44 are evenly turned on, then the laser head 38 may move linearly forward or in reverse depending on the position of the orientation nozzles 44.

In various embodiments, the orientation nozzles 44 may be fixedly connected to the laser head 38 for limited motion control or be movably mounted to the laser head 38 for essentially unlimited motion control of the perforation unit 32. In one embodiment, the orientation nozzles 44 are movably mounted to the laser head 38 via servo motors with swivel joints that may control whether the openings 43 face rearward (forward motion), forward (reverse motion), or at an angle to a central axis 47 (rotational motion or a combination of linear and rotational motion depending on the angular displacement of the orientation nozzle 44 relative to the central axis 47). For example, if the orientation nozzles 44 are aligned perpendicular to the central axis 47, the orientation nozzles 44 may only provide rotational motion. If the orientation nozzles 44 are parallel to the central axis 47, then the orientation nozzles 44 may only provide linear motion. A combination of rotational and linear motion is provided for any other angular position relative to the central axis 47. The fluid lines for providing the thrust may be coupled to the nozzles via swivel couplings as known in the art.

FIG. 4 depicts a laser head 38 with additional features, such as fiber optic sensors 54 for temperature, pressure, or both; and acoustic sensing/logging fibers 56 to monitor the laser perforation tool 20 performance and collect formation information as logging.

Generally, various advantages of using the high power laser tools disclosed herein include the elimination of using chemicals, such as acids, or other chemicals to penetrate the formation, and the elimination of using high pressures and forces, such as jetting, to drill the hole. However, the laser still requires one or more fluids, but these fluids are used to purge and clean the hole from the debris, opening up a path for the laser beam, and to orient the laser head 38. FIG. 4 depicts an internal configuration of the laser head 38 that is configured to have the purge fluid 58 merge with the laser beam 42. As shown in FIG. 4, the purge fluid 58 is merged with the laser beam 42, with the flow direction 60 running longitudinally through the channels 59 formed within the laser head 38.

Figure 6:
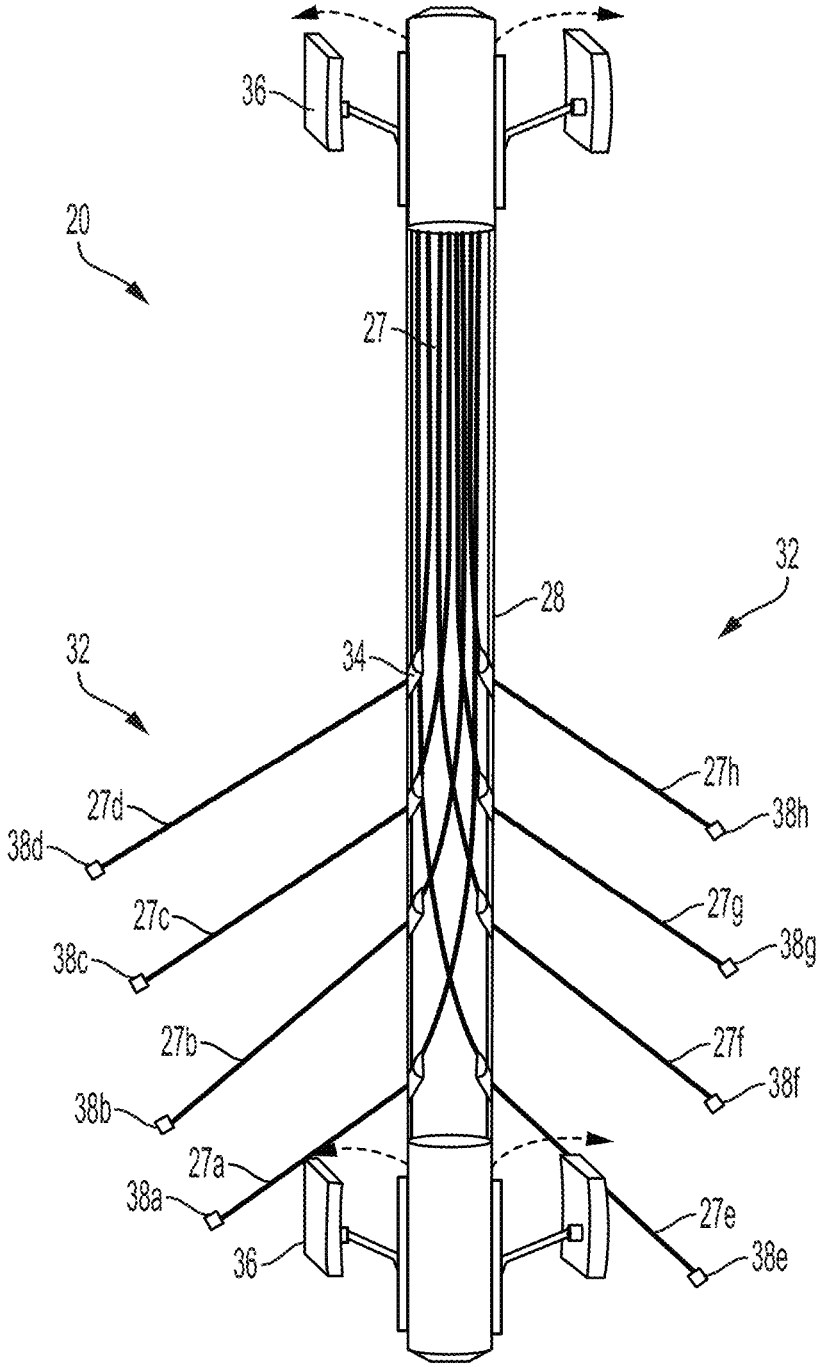
FIG. 6 is a schematic representation of the laser tool of FIG. 2 shown deployed within a hydrocarbon bearing formation in accordance with one or more embodiments of the invention.

FIG. 6 depicts the laser perforation tool 20 in a deployed configuration, where the perforation units 32 have been extended outside of the elongated body 28 through the exit ports 34. As previously discussed, the embodiment shown includes eight (8) perforation means 32 including the fiber optic cables 27*a*-27*h* and laser heads 38*a*-38*h*. The perforation units 32 depicted are substantially rigid.

In various embodiments, the laser perforation tool 20 is introduced into the wellbore 24 via a coiled tubing unit that provides a reel, power and fluid for the tool, and host all of the laser supporting equipment. The laser source may be also coupled to the coiled tubing unit. The laser generator 30 is switched off while the laser perforation tool 20 is being inserted into the wellbore 24. Once the laser perforation tool 20 reaches the target, typically an open hole, the centralizers 36 may inflate to centralize the tool at that location and the laser may turn on along with the source of purge fluid 58 for the purging nozzles 46 and orientation nozzles 44, if included. The perforation units 32 may be deployed into the formation from the coiled tubing or by the laser perforation tool 20 itself through a screw rod 68, as shown in FIG. 15B.

Figure 9:
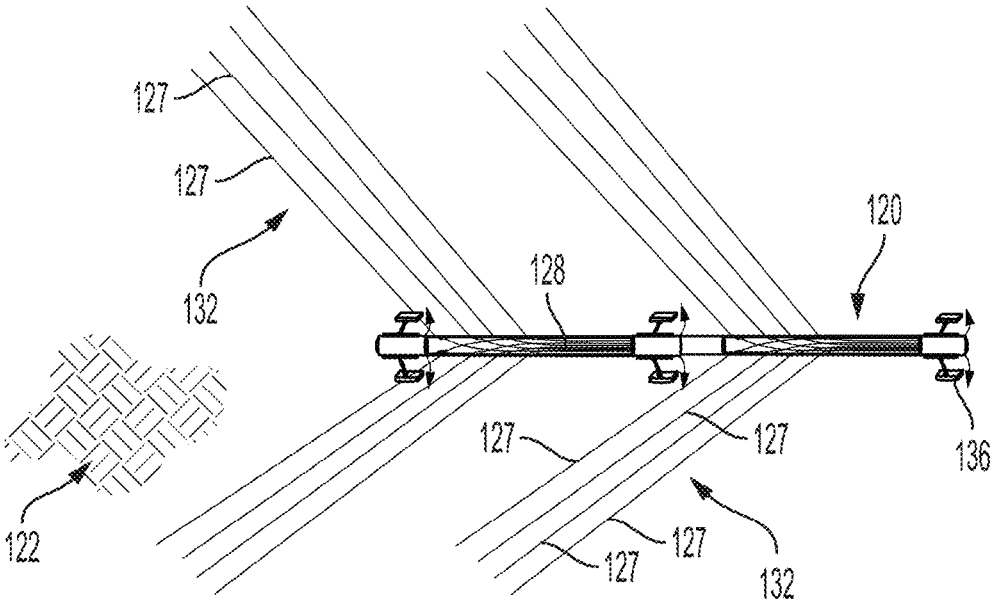
FIG. 9 is a schematic representation of an alternative laser tool in accordance with one or more embodiments.

In various embodiments, each fiber optic cable 27, with shielding, measures about one (1) inch in diameter. Accordingly, an eight (8) inch wellbore can hold seven (7) fiber optic cables, and so on. FIG. 9 depicts an operation where the laser is on and the perforation units 132 are penetrating deeper into the formation 122. Because the fiber optic cables 127 of the perforation units 132 are substantially rigid (see, for example, FIG. 11), the perforation units 132 may penetrate in substantially straight lines. The perforation units 132 may reach as deep as needed, because the fiber optic cables 127 can be as long as the drilling string from the ground into the wellbore and laser perforation tool 120. Generally, the embodiment depicted in FIG. 9 may have the same basic structure as the laser perforation tool 20 previously described; however, the number and locations of the perforation units 132 may be different. Specifically, there are multiple arrays disposed along the length of the laser perforation tool 120 separated into different zones by the centralizers 136.

Figure 10:
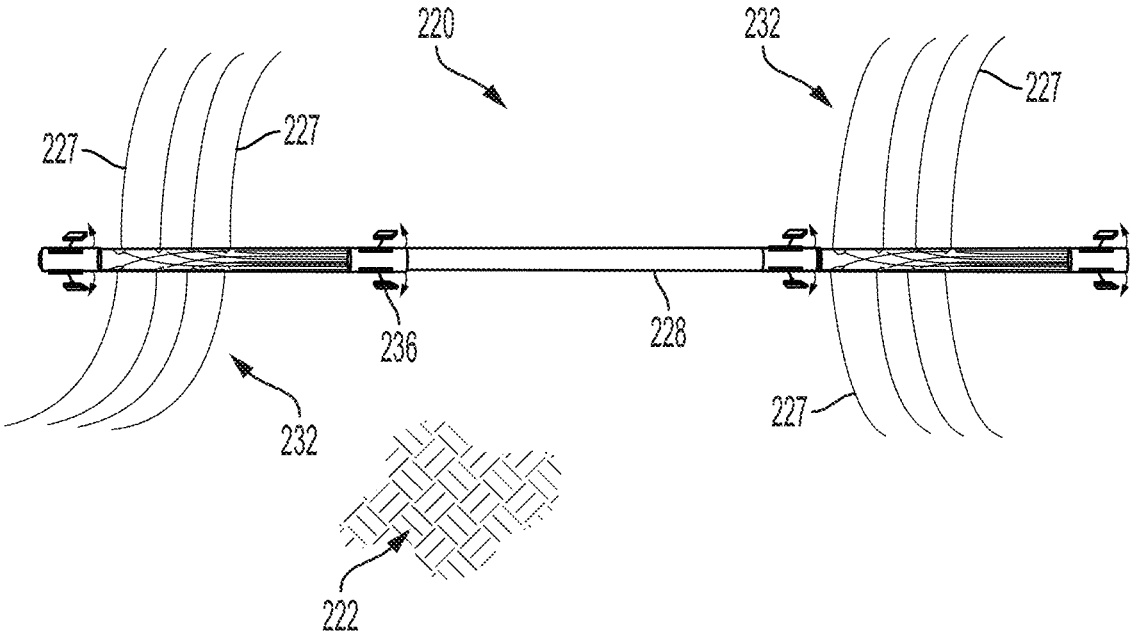
FIG. 10 is a schematic representation of another alternative laser tool in accordance with one or more embodiments.

In some embodiments, the target must be reached by maneuvering the perforation units 232 to the target. FIG. 10 depicts an embodiment of the laser perforation tool 220 in which the perforation units 232 use cables with flexible casings 264 (see, for example, FIG. 12) with orientation capabilities, such as the orientation nozzles 44 previously described. Similar to the tool shown in FIG. 9, the laser perforation tool 220 may include multiple arrays disposed along the length of the laser perforation tool 220 separated into different zones by the centralizers 236. As can be seen in FIG. 10, the perforation units 232 may be deployed substantially perpendicular to the elongated body 228 and steered along an irregular path as necessary to reach a desired target. The path may include any number and combination of linear and curved segments as necessary. In some embodiments, the ability to maneuver the perforation units 232 within the formation may assist deep and targeted penetration.

In various embodiments, the laser perforation tools 20, 120, 220 disclosed herein include additional nozzles or casings 70 that house the fiber optic cables 27, 127, 227 to assist in deploying and advancing the fiber optic cables 27, 127, 227 within the formation. The casing 70 may be pre-perforated or a mesh type to allow a flow of oil or gas from the formation 22, 122, 222 into the wellbore 24. In some embodiments, once the perforation units 32 and casings 70 reach their intended target, the fiber optic cables 27 may be retrieved and another set of fiber optic cables may be used for different locations in the wellbore 24. Alternatively or additionally, the fiber optic cables 27 may be removed to allow for the flow of gas or oil through the casings 70 to the wellbore 24.

Figure 7:
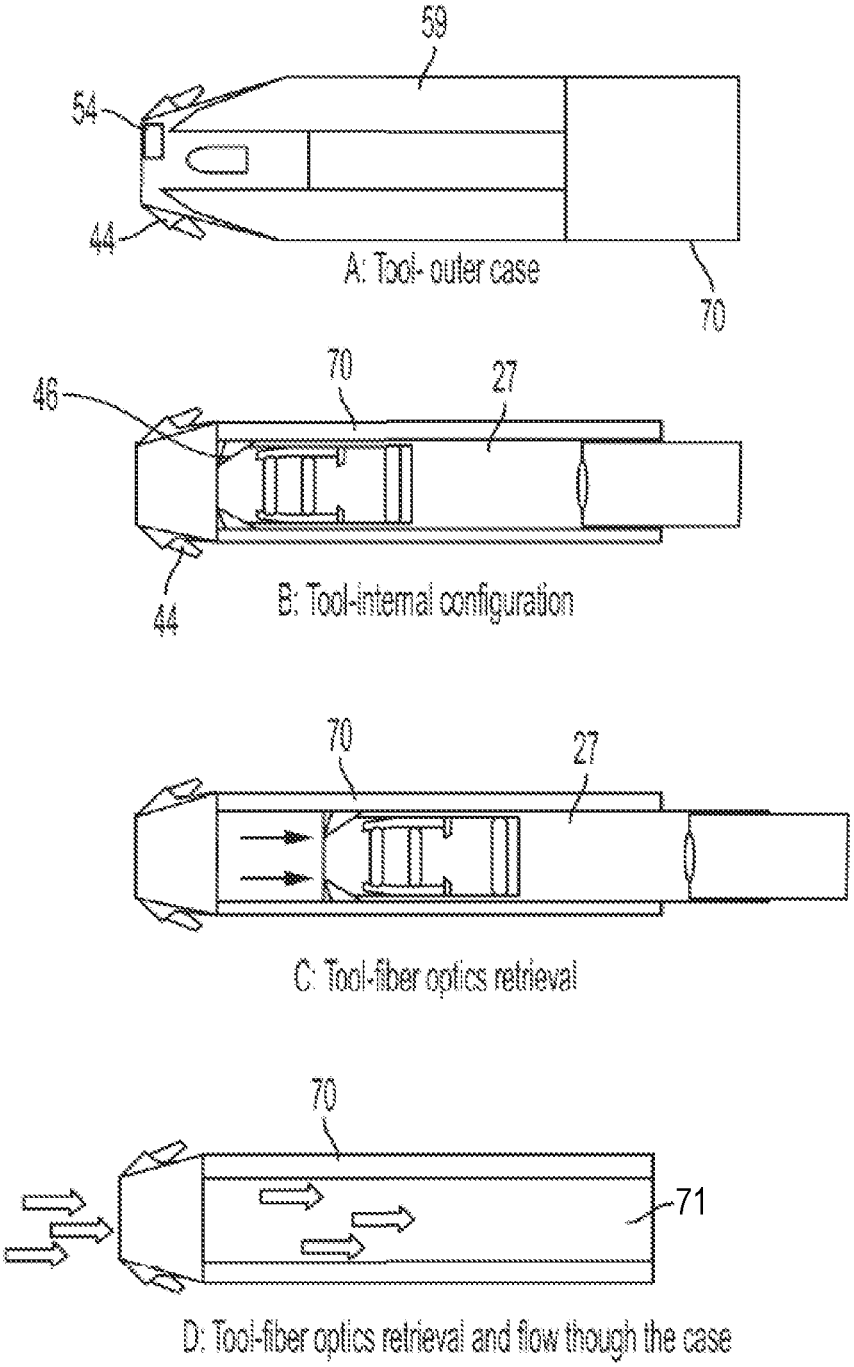
FIG. 7 is a schematic representation of four operational steps of a laser head in accordance with one or more embodiments.

FIG. 7 depicts the fiber optic cable 27 retrieval process. Step A illustrates the laser head portion of the outer casing 70 with such features as the orientation nozzles 44 and fluid purging channels 59, but without the fiber optic cable 27 inserted. Step B illustrates the present internal configuration of the casing head with the fiber optic cable 27 attached to the casing head. Step C illustrates the fiber optic cable 27 unscrewed or unplugged from the head and being removed from the casing 70, which may be done via the coiled tubing unit. Generally, the fiber optic cable 27 may be secured within the laser head 38 portion of the casing 70 via any known mechanical fastening means, such as, for example, threaded hardware, quick disconnect couplings, magnets, or an inflatable/deflatable device. For example, for an inflatable/deflatable device, the connection may be inflated while it is connected and deflated for retrieval. The inflation/deflation may be controlled electrically, hydraulically, or mechanically. Step D illustrates the complete removal of the fiber optic cable 27 and a hydrocarbon fluid 71 flowing into the casing 70. In this embodiment, the casing 70 is acting as a completion pipe that the fluid flows through into the wellbore 24. In some embodiments, an alternative fiber optic cable or other tool may be inserted into the casing 70 to perform additional tasks.

Figure 13:
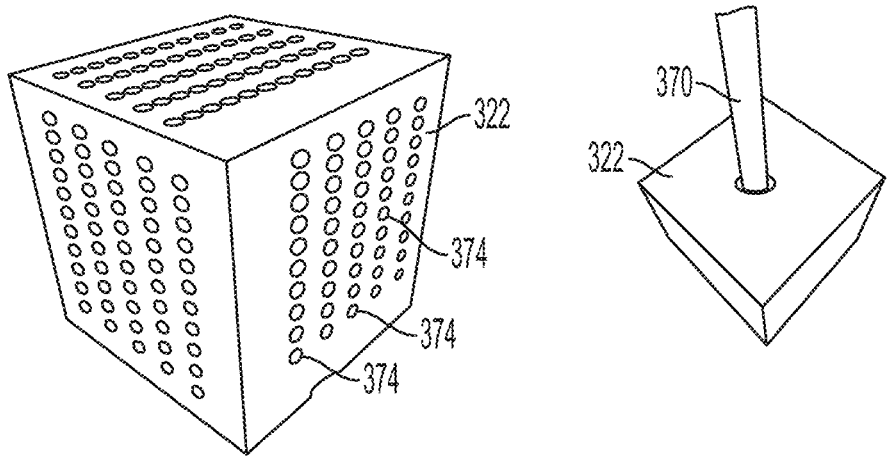
FIG. 13 is a pictorial representation of a sample rock formation after operation of one embodiment of a laser tool in accordance with one or more embodiments of the methods disclosed herein.

One advantage of using high power laser technology is the ability to create controlled non-damaged, clean holes for various types of the rock. FIG. 13 represents a proof of concept example for a tool as described herein. As shown on the right, a single fiber optic cable 327 and casing 370 are introduced to a sample rock formation 322. On the left, is the rock formation 322 after a series of holes 374 have been drilled into the formation 322 with a tool in accordance with one or more embodiments described herein.

Figure 14:
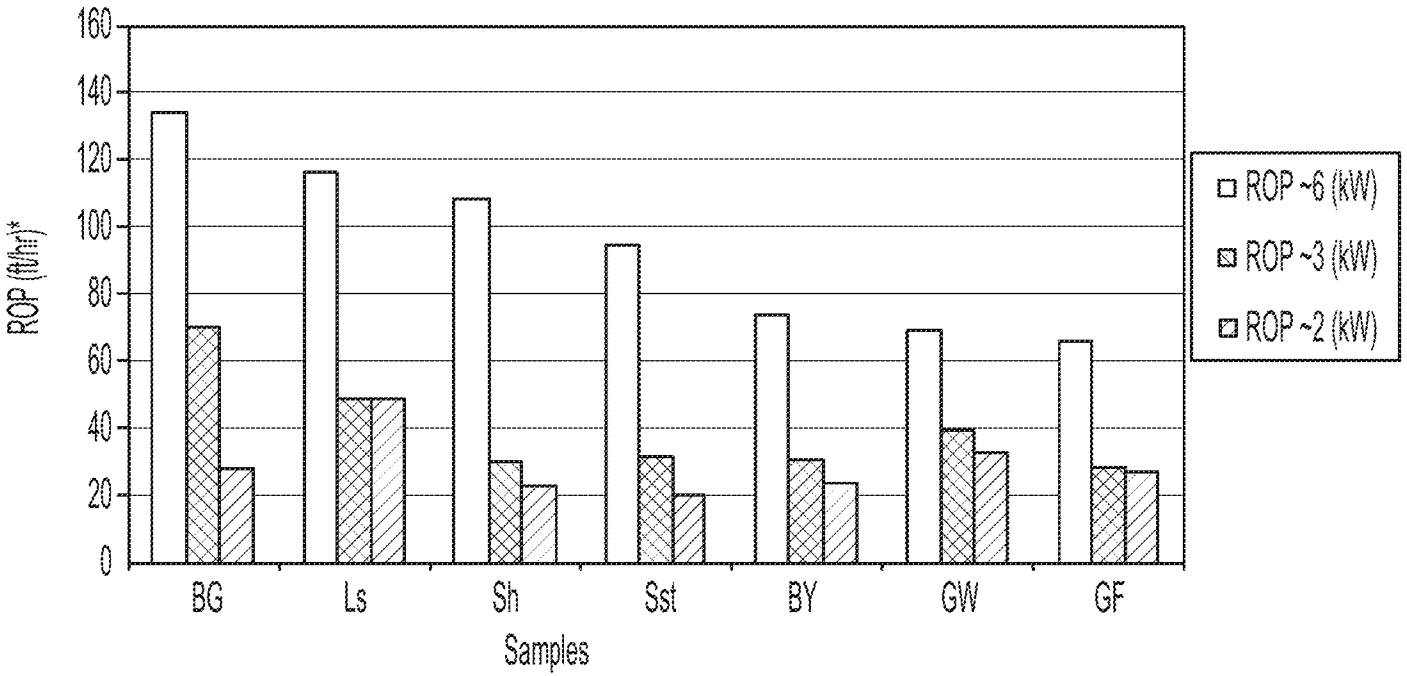
FIG. 14 is a graphical representation of the results of the use of a tool in accordance with one or more embodiments of the methods disclosed herein.

The laser perforation tools disclosed herein have capability to penetrate in many types of rocks having various rock strengths and stress orientations, as shown in the graph of FIG. 14. The graph represents the Rate of Penetration (ROP) in feet per hour (ft/hr) for a variety of materials, where BG and BY=Brea Gray, Ls=limestone, Sh=shale, Sst=sandstone, and GW and GF=granite. The laser strengths used were at 2 kW, 3 kW, and 6 kW power.

In general, the construction materials of the laser perforation tool 20 may be of materials that are resistant to the high temperatures, pressures, and vibrations that may be experienced within an existing wellbore, and that can protect the system from fluids, dust, and debris. Materials that are resistant to hydrogen sulfide are also desirable. One of ordinary skill in the art will be familiar with suitable materials.

The laser generator 30 may excite energy to a level greater than a sublimation point of the hydrocarbon bearing formation, which is output as the raw laser beam. The excitation energy of the raw laser beam required to sublimate the hydrocarbon bearing formation can be determined by one of skill in the art. In some embodiments, the laser generator 30 may be tuned to excite energy to different levels as required for different hydrocarbon bearing formations. The hydrocarbon bearing formation may include limestone, shale, sandstone, or other rock types common in hydrocarbon bearing formations. The discharged laser beam may penetrate a wellbore casing, cement, and hydrocarbon bearing formation to form, for example, holes or tunnels.

The laser generator 30 may be of laser unit capable of generating high power laser beams, which may be conducted through a fiber optic cable 27, such as, for example, lasers of ytterbium, erbium, neodymium, dysprosium, praseodymium, and thulium ions. In some embodiments, the laser generator 30 includes, for example, a 5.34-kW Ytterbium-doped multi-clad fiber laser. In some embodiments, the laser generator 30 may be of laser capable of delivering a laser at a minimum loss. The wavelength of the laser generator 30 may be determined by one of skill in the art as necessary to penetrate hydrocarbon bearing formations.

Figure 16A:
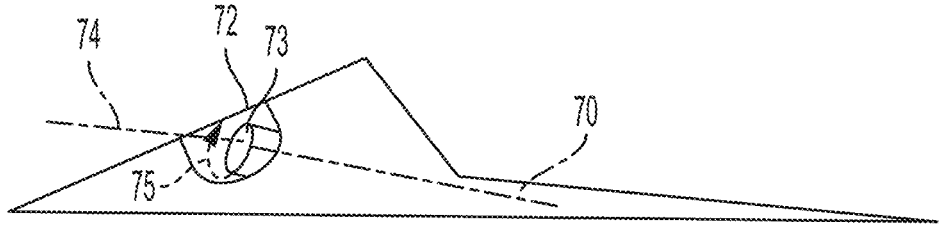
FIGS. 16A-16C illustrate laser pathway alterations using a beam redirection tool, according to aspects of the present disclosed embodiments.
Figure 16B:
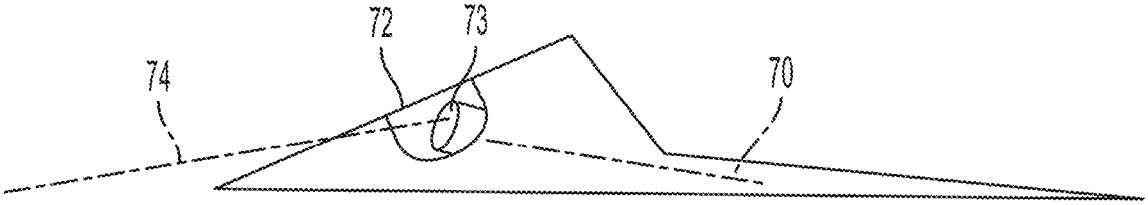
Figure 16C:
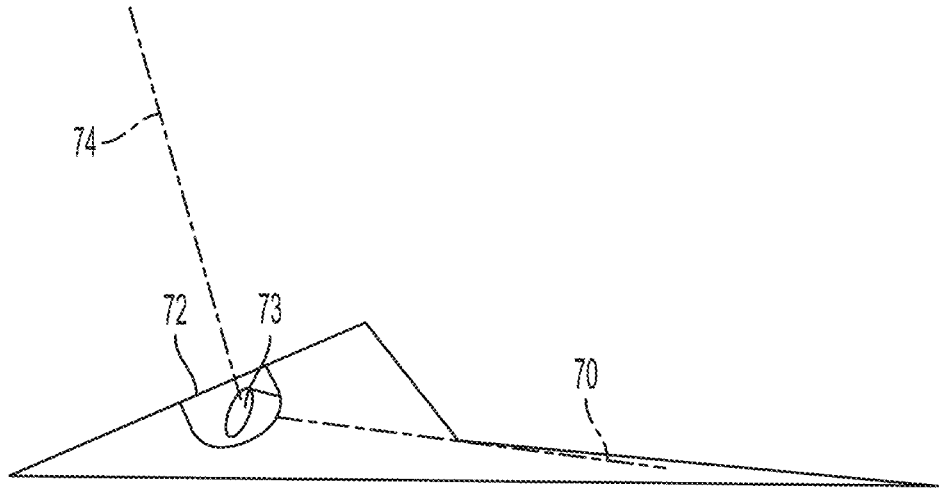
Figure 17B:
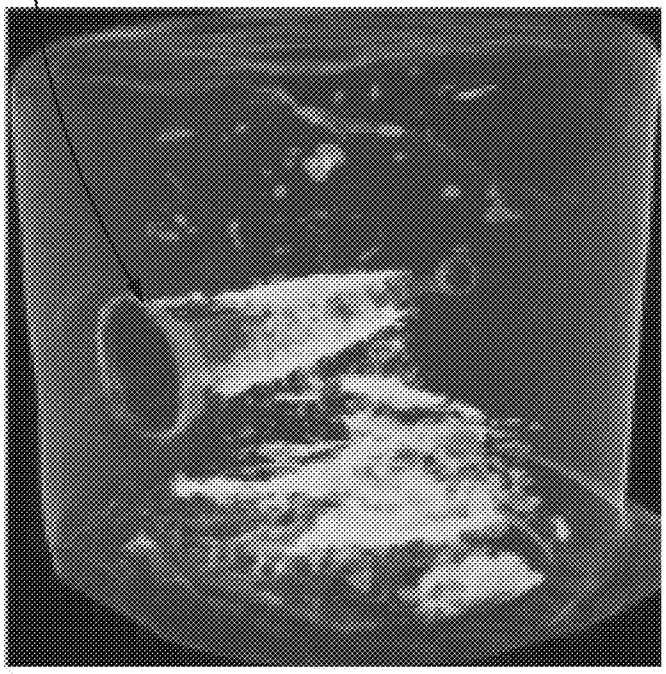
FIGS. 17A and 17B are pictorial representations of a sample rock formation having a single perforation created by one embodiment of a laser tool in accordance with one or more embodiments of the methods disclosed herein.

FIGS. 16A-16C illustrate laser beams generated by the laser perforation tool 20 including one or more perforation units that are or include a beam redirection tool 72, according to aspects of the present disclosed embodiments. Example laser beams may be used to perforate rock, for example, as illustrated in FIG. 17 and FIG. 18. The exit port 34 of the laser perforation tool 20 may be or may include the beam redirection tool 72. The beam redirection tool 72 may be connected to a fiber optic cable, for example, fiber optic cable 27, an optical assembly, for example. optical assembly 40, or a laser head, for example, laser head 38. The laser beam 70 may be received the beam redirection tool 72 from a fiber-optic cable, for example, fiber optic cable 27, or from an optical assembly 40, or a laser head 38, and may be redirected via the beam redirection tool 72 so that the redirected laser beam 74 advances in a different direction from laser beam 70, as shown in FIGS. 16A-16C. The target direction may be decided based on the wellbore conditions (for example, temperature, pressure, rock composition, structure, or porosity) that may be collected by sensors on the laser perforation tool 20. The exit port 34 may also include orientation nozzles 44 or purging nozzles 46, so that the purging fluid (for example, water, hydrocarbon, nitrogen gas) can be delivered to an area proximate each of the output laser beams. The purging may remove debris and protect the lens 48, 50, 52 from the debris that may fly back to the laser perforation tool 20.

In some embodiments, the beam redirection tool 72 includes one or more moveable optical elements 73, for example, a prism, a mirror, a reflector, or combinations thereof. In some embodiments, the beam redirection tool 72 operates the one or more optical elements 73 electrically or hydraulically, or both. In some embodiments, an optical element 73 may be rotated about one or more axes as indicated by arrow 75, thereby redirecting the laser beam 70 so that the redirected laser beam 74 advances in a different direction from laser beam 70.

In some embodiments, an angle between the laser beam 70 (i.e., the beam prior to entering redirection tool 72) and the redirected laser beam 74 (i.e., the beam after exiting the beam redirection tool 72) is within a range of 1° to 180°. In some embodiments, an angle between the laser beam 70 and the redirected laser beam 74 is within a range of 30° to 180°. In some embodiments, an angle between the laser beam 70 and the redirected laser beam 74 is within a range of 60° to 180°. In some embodiments, an angle between the laser beam 70 and the redirected laser beam 74 is within a range of 90° to 180°. In some embodiments, an angle between the laser beam 70 and the redirected laser beam 74 is within a range of 120° to 180°. In some embodiments, an angle between the laser beam 70 and the redirected laser beam 74 is within a range of 150° to 180°. In some embodiments, an angle between the laser beam 70 and the redirected laser beam 74 is within a range of 30° to 150°. In some embodiments, an angle between the laser beam 70 and the redirected laser beam 74 is within a range of 60° to 150°. In some embodiments, an angle between the laser beam 70 and the redirected laser beam 74 is within a range of 90° to 150°. In some embodiments, an angle between the laser beam 70 and the redirected laser beam 74 is within a range of 120° to 150°. In some embodiments, an angle between the laser beam 70 and the redirected laser beam 74 is within a range of 30° to 120°. In some embodiments, an angle between the laser beam 70 and the redirected laser beam 74 is within a range of 60° to 120°. In some embodiments, an angle between the laser beam 70 and the redirected laser beam 74 is within a range of 90° to 120°. In some embodiments, an angle between the laser beam 70 and the redirected laser beam 74 is within a range of 30° to 90°. In some embodiments, an angle between the laser beam 70 and the redirected laser beam 74 is within a range of 60° to 90°.

Figure 19:
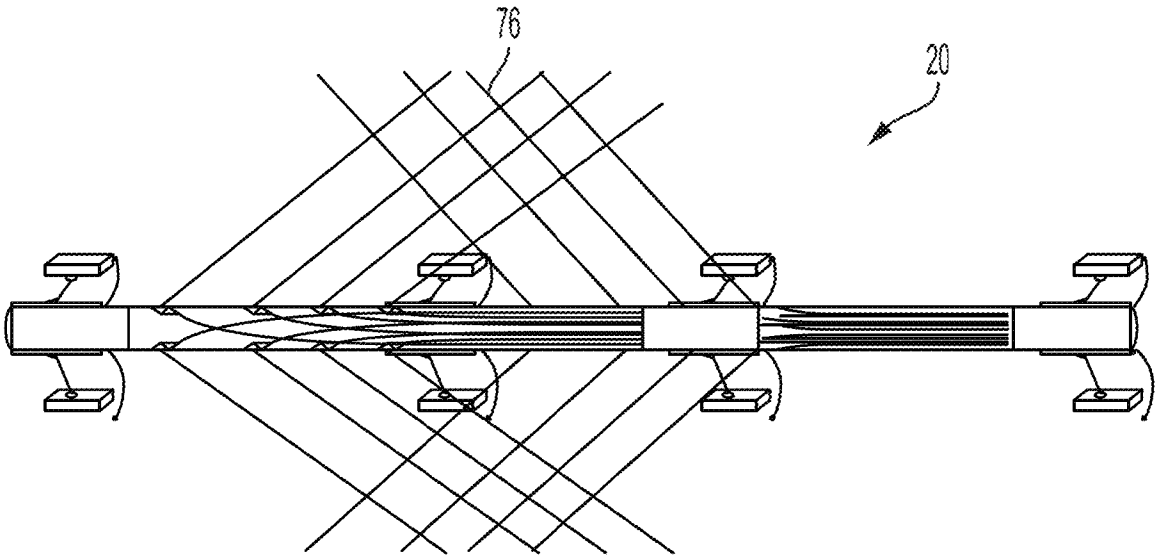
FIG. 19 is a schematic representation of laser beams created by a laser perforation tool including a plurality of beam redirection tools in accordance with one or more embodiments of the methods disclosed herein.

In some embodiments, a first laser beam exiting a first beam redirection tool propagates in a different direction from a second laser beam exiting a second beam redirection tool. For example, the laser perforation tool 20 may release laser beams propagating in multiple directions. In some embodiments, the redirected laser beams 74 exiting the beam redirection tool 72 may cross each other, forming laser beam network. In some embodiments, the redirected laser beams 74 exiting the beam redirection tool 72 may create a set of perforations in a first direction, and then, after advancing the laser perforation tool 20 downhole, create a second set of perforations, thereby forming network of perforations 76 as shown in FIG. 19. The wide controllability with respect to the laser beam directions may be particularly useful when the space between the wellbore 24 and the laser perforation tool 20 is small (for example, where the deployment of the fiber optic cable 27 or the orientation range of the laser head 38 (via the orientation nozzle 44) is limited and restricted).

Figure 20:
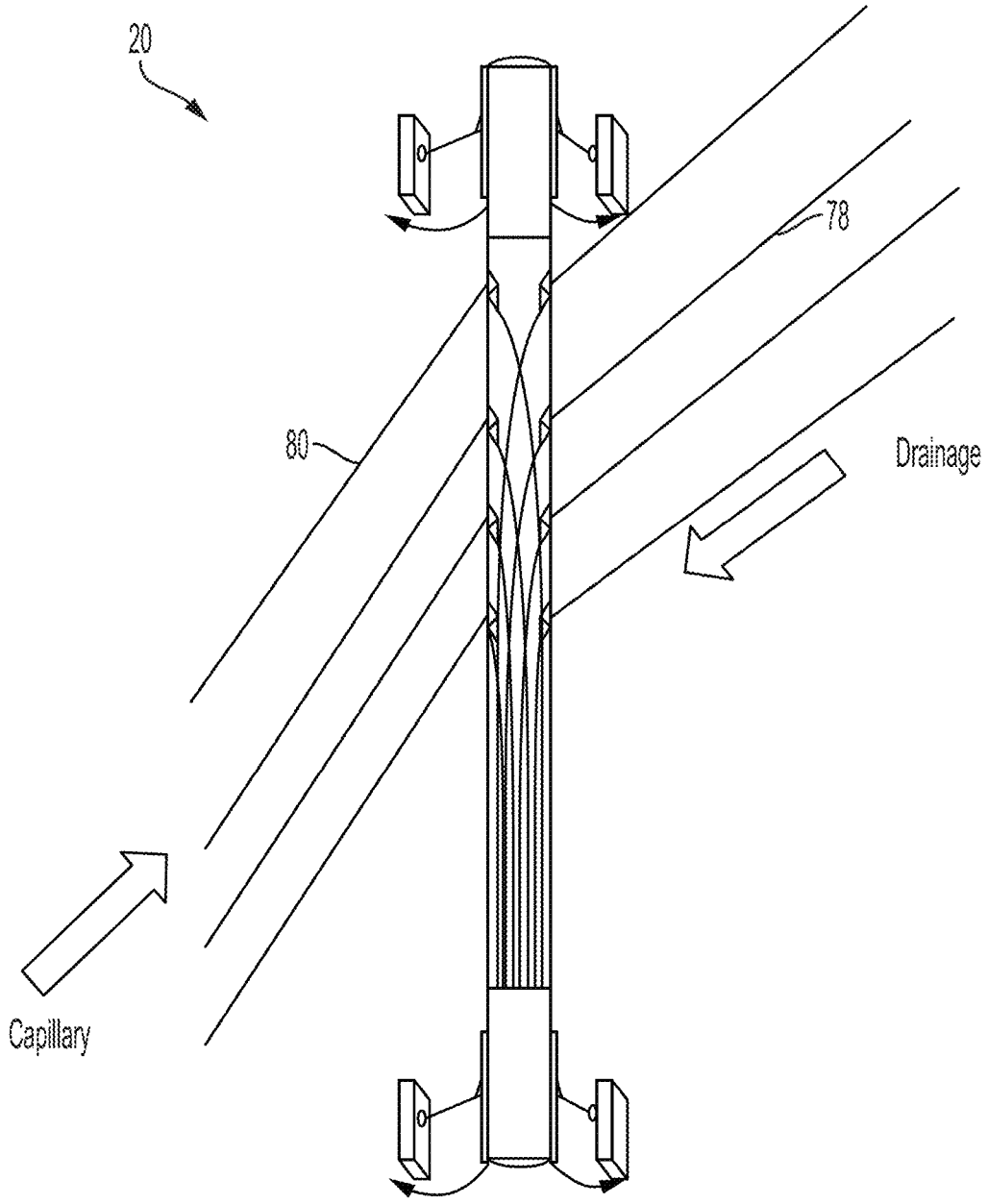
FIG. 20 is a schematic representation of a laser perforation tool including a plurality of beam redirection tools in a vertical direction in accordance with one or more embodiments of the methods disclosed herein.

Referring to FIG. 20, the laser perforation tool 20 and its elongated body 28 may extend vertically (for example, parallel to the wellbore) and may be oriented uphole or downhole. In some embodiments, the laser perforation tool 20 generates one or more laser beams propagating upwardly creating perforations 78. In such embodiments, hydrocarbon may be extracted from the perforation via gravitational force. In some embodiments, the laser perforation tool 20 generates one or more laser beams propagating downwardly creating perforations 80. In such embodiments, hydrocarbon may be extracted from the perforation via capillary force.

Figure 21:
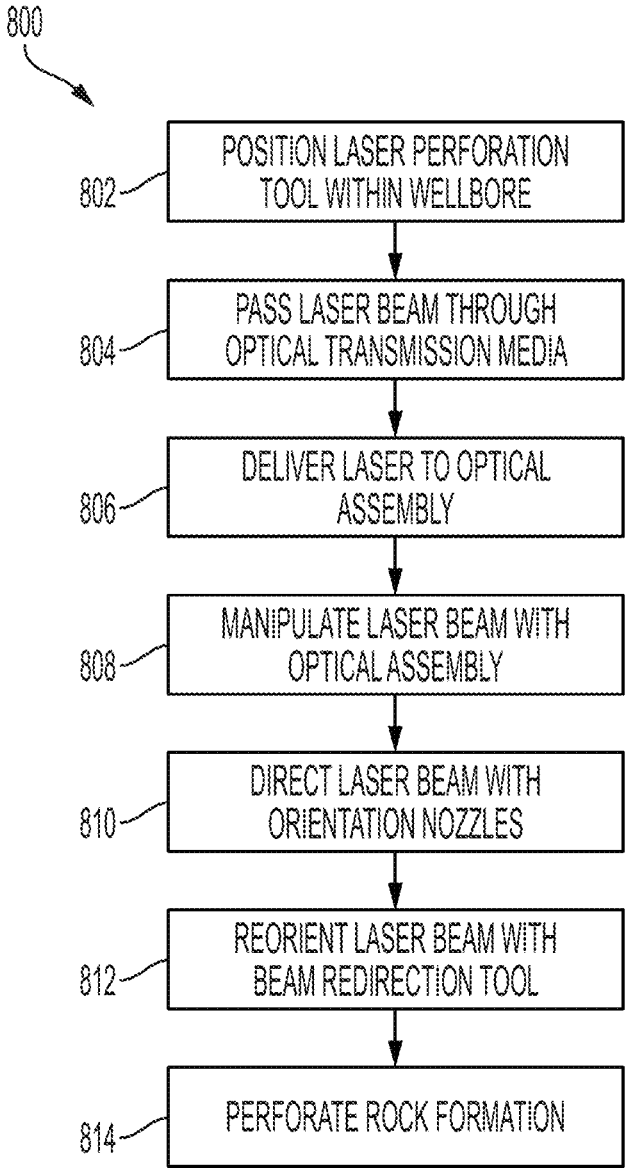
FIG. 21 is a flow chart illustrating an example laser perforation method disclosed herein.

FIG. 21 illustrates a method 800 of enhancing oil recovery using the laser perforation tool 20, according to aspects of the present disclosed embodiments. At step 802, the method 800 may include positioning the laser perforation tool 20 within the wellbore 24. At step 804, the method 800 may include passing laser beams generated from the laser generator 30 through the optical transmission media (for example, fiber optic cables). At step 806, the method 800 may include delivering the laser beams to optical assemblies 40 in order to shape or collimate the laser beams as necessary (step 808). At step 810, the method 800 may include directing/positioning the laser beams (and/or the laser head 38) via the orientation nozzles 44. In some embodiments, the laser perforation tool 20 may be operated in the presence of purging. At step 812, the method 800 may include redirecting the laser beams via the beam redirection tools 72. At step 814, the method 800 may include perforating the rock formation via the redirected laser beams.

At least part of the laser perforation tool and its various modifications may be controlled, at least in part, by a computer program product, such as a computer program tangibly embodied in one or more information carriers, such as in one or more tangible machine-readable storage media, for execution by, or to control the operation of, data processing apparatus, for example, a programmable processor, a computer, or multiple computers, as would be familiar to one of ordinary skill in the art.

It is contemplated that systems, devices, methods, and processes of the present application encompass variations and adaptations developed using information from the embodiments described in the following description. Adaptation or modification of the methods and processes described in this specification may be performed by those of ordinary skill in the relevant art.

Throughout the description, where compositions, compounds, or products are described as having, including, or comprising specific components, or where processes and methods are described as having, including, or comprising specific steps, it is contemplated that, additionally, there are articles, devices, and systems of the present application that consist essentially of, or consist of, the recited components, and that there are processes and methods according to the present application that consist essentially of, or consist of, the recited processing steps.

It should be understood that the order of steps or order for performing certain actions is immaterial, so long as the described method remains operable. Moreover, two or more steps or actions may be conducted simultaneously.

Examples

In order that the application may be more fully understood, the following examples are set forth. It should be understood that these examples are for illustrative purposes only and are not to be construed as limiting in any manner. The present Example describes creation of perforation(s) using the laser perforation tool as described in the present disclosure.

Figure 17A:
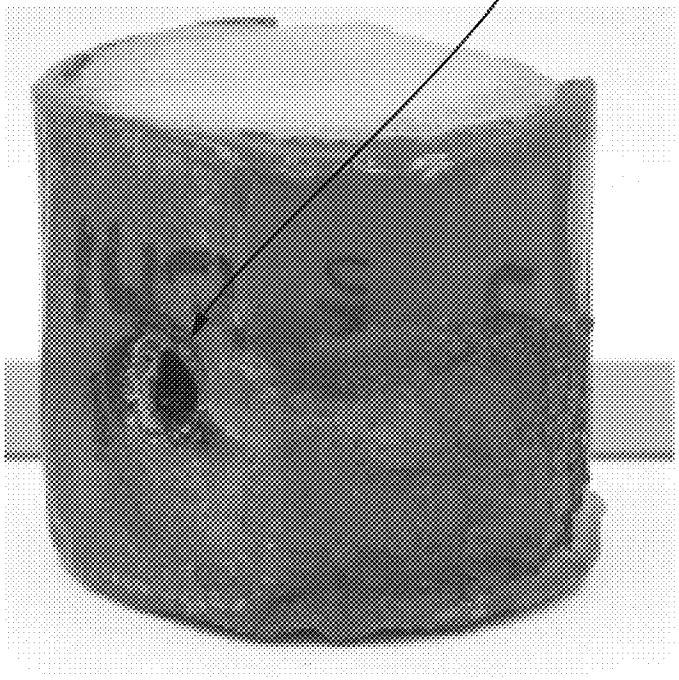
Figure 18B:
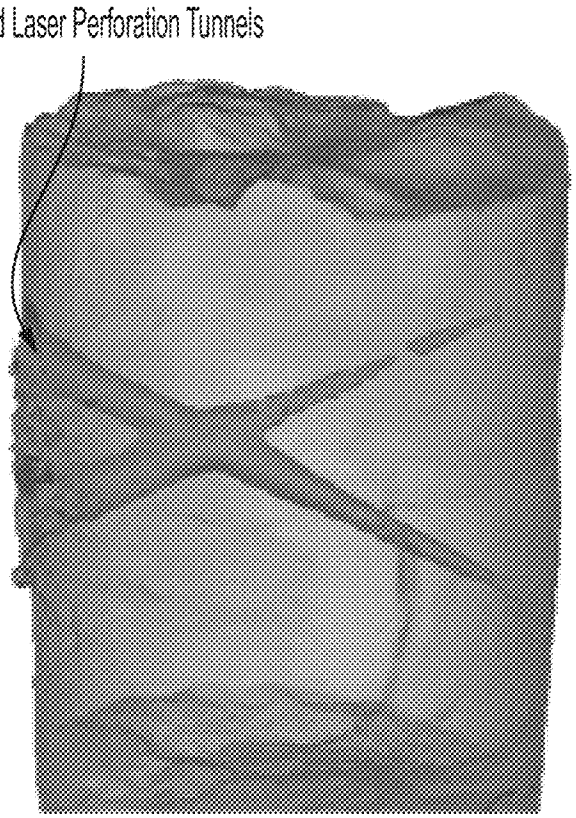
FIGS. 18A and 18B are pictorial representations of a sample rock formation having cross perforations created by one embodiment of a laser tool in accordance with one or more embodiments of the methods disclosed herein.
Figure 18A:
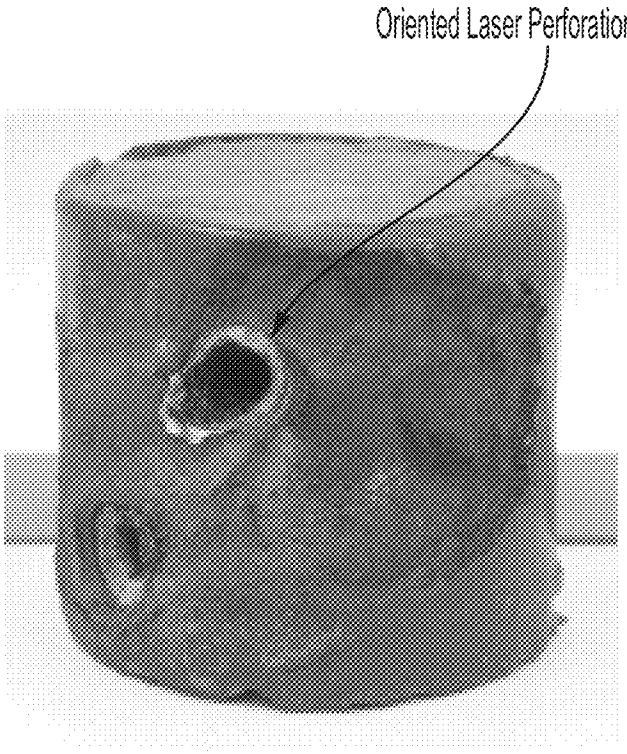

A sample shale block (4 inches in diameter by 5 inches in length) was perforated as shown in FIG. 17A with the laser perforation tool as described in this specification. A computerized axial tomography scan (CAT scan) was used to evaluate the internal structure of the sample. As shown in FIG. 17B, the tunnel was created within the sample, connecting the opposite ends. In another example, shown in FIGS. 18A (optical image of the sample) and 18B (CAT scan image of the sample), two perforations were created, crossing each other.

What is claimed is:

1. A laser perforation tool for perforating a wellbore in a downhole environment within a hydrocarbon bearing formation, the laser perforation tool comprising:

a plurality of perforation units disposed within an elongated body of the laser perforation tool, the laser perforation tool comprising a series of exit ports disposed about the circumference of the elongated body to allow the perforation units to be deployed into the formation, each of the plurality of perforation units comprising:

an optical transmission media passing a raw laser beam generated from a laser generator, wherein the optical transmission media extends within an elongated body of the laser perforation tool;

a laser head receiving the raw laser beam from, and coupled to the optical transmission media, wherein the laser head comprises an optical assembly controlling at least one characteristic of an output laser beam; and a beam redirection tool coupled to the laser head, wherein the beam redirection tool alters a direction of the output laser beam, wherein the plurality of perforation units have been extended outside of the elongated body through the exit ports.

2. The laser perforation tool of claim 1, wherein the laser perforation tool creates at least two perforations in the wellbore, and the at least two perforation are not parallel to each other.

3. The laser perforation tool of claim 2, wherein the at least two perforations cross each other, and wherein the plurality of perforation units are deployed into the formation using at least one screw rod.

4. The laser perforation tool of claim 1, wherein the elongated body extends vertically within the wellbore.

5. The laser perforation tool of claim 4, wherein the laser perforation tool creates one or more perforations in the wellbore, and the one or more perforations drain a hydrocarbon by gravitational force, and wherein the plurality of perforation units are deployed into the formation using coiled tubing.

6. The laser perforation tool of claim 4, wherein the laser perforation tool creates one or more perforations in the wellbore, and the one or more perforations drain a hydrocarbon by capillary force, and wherein the plurality of perforation units are deployed substantially perpendicular to the elongated body and steered along an irregular path as necessary to reach a desired target using flexible casings.

7. The laser perforation tool of claim 4, wherein the laser perforation tool creates one or more perforations in the wellbore, at least one of the one or more perforations drains a hydrocarbon by gravitational force, and at least one of the one or more perforations drains a hydrocarbon by capillary force.

8. The laser perforation tool of claim 1, comprising a plurality of orientation nozzles disposed about an outer circumference of the laser head, wherein the plurality of orientation nozzles control motion and orientation of the laser head within the wellbore, and wherein the series of exit ports is oriented in a spiral-like pattern with each exit port being spaced along a length of the elongated body and radially off-set at regular angular intervals.

9. The laser perforation tool of claim 8, wherein the plurality of orientation nozzles provide forward, reverse, or rotational motion to the laser head within the wellbore, and wherein each exit port is radially off-set at regular angular intervals of about every 30 degrees.

10. The laser perforation tool of claim 8, wherein the plurality of orientation nozzles are purging nozzles providing thrust to the laser head for movement within the wellbore.

11. The laser perforation tool of claim 8, wherein the plurality of orientation nozzles are movably coupled to the laser head thereby allowing the orientation nozzles to rotate or pivot relative to the laser head, and the plurality of orientation nozzles provide forward motion, reverse motion, rotational motion, or combinations thereof to the laser head relative to the tool.

12. The laser perforation tool of claim 1, comprising a purging assembly disposed at least partially within or adjacent to the laser head, wherein the purging assembly delivers a purging fluid to an area proximate the output laser beam.

13. The laser perforation tool of claim 12, wherein the purging assembly comprises purging nozzles, at least a portion of the purging nozzles are vacuum nozzles connected to a vacuum source, and the purging nozzles remove debris and/or gaseous fluids from the area proximate the output laser beam when vacuum is applied.

14. The laser perforation tool of claim 1, wherein the optical assembly comprises one or more lenses, and wherein the optical assembly comprises a first lens focusing the raw laser beam and a second lens shaping the output laser beam.

15. The laser perforation tool of claim 14, wherein a distance between the first lens and the second lens is adjustable to control a size of the output laser beam.

16. The laser perforation tool of claim 1, further comprising a centralizer coupled to the laser perforation tool, wherein the centralizer holds the laser perforation tool in the wellbore.

17. The laser perforation tool of claim 16, wherein the laser perforation tool comprises a plurality of centralizers disposed on the elongated body, and a first portion of the plurality of centralizers is disposed forward of the plurality of perforation units and a second portion of the plurality of centralizers is disposed aft of the plurality of perforation units.

18. The laser perforation tool of claim 1, wherein the laser head is a distal portion of a tubing unit disposed within the elongated body and deployable from the elongated body.

19. The laser perforation tool of claim 1, comprising a plurality of orientation nozzles disposed about an outer circumference of the laser head, wherein the plurality of orientation nozzles control motion and orientation of the laser head within the wellbore, and wherein the plurality of orientation nozzles are movably mounted to the laser head via servo motors with swivel joints that control whether openings disposed within each of the orientation nozzles face rearward, forward, at an angle with a central axis of the laser perforation tool, or a combination of at an angle and rearward or forward.

20. A method of using a laser perforation tool, the method comprising steps of:

(i) positioning the laser perforation tool within a wellbore within a hydrocarbon bearing formation, the laser perforation tool comprising a plurality of perforation units disposed therein, each of the plurality of perforation units comprising:

(a) an optical transmission media within an elongated body of the laser perforation tool;

(b) a laser head coupled to the optical transmission media, wherein the laser head comprises an optical assembly controlling at least one characteristic of an output laser beam; and (c) a beam redirection tool coupled to the laser head for altering a direction of the output laser beam, (ii) passing, through one or more optical transmission media, at least one raw laser beam generated by a laser generator;

(iii) delivering a raw laser beam to each of the optical assemblies;

(iv) manipulating the raw laser beams with the optical assemblies to generate output laser beams;

(v) manipulating the direction of the output laser beams with the beam redirection tools;

(vi) delivering the output laser beams to the formation;

(vii) decoupling the laser head from the optical transmission media; and (viii) flowing at least one fluid from the formation through the laser head into the wellbore.

21. A method of using a laser perforation tool, the method comprising steps of:

(i) positioning the laser perforation tool within a wellbore within a hydrocarbon bearing formation, the laser perforation tool comprising a plurality of perforation units disposed therein, each of the plurality of perforation units comprising:

(a) an optical transmission media within a casing of the laser perforation tool; and (b) a laser head coupled to the optical transmission media, wherein the laser head comprises an optical assembly controlling at least one characteristic of an output laser beam; and (ii) delivering the output laser beams to the formation;

(vii) decoupling the laser head from the optical transmission media; and (viii) flowing at least one fluid from the formation through the laser head and casing, and into the wellbore.

22. The method of claim 21, further comprising removing the optical transmission media from the casing, wherein decoupling the laser head from the optical transmission media comprises at least one of unplugging and unscrewing the laser head from the optical transmission media.

23. The method of claim 21, wherein decoupling the laser head from the optical transmission media comprises using a coiled tubing unit.

24. The method of claim 21, wherein upon decoupling the laser head from the optical transmission media, the casing acts as a completion pipe that the at least one fluid flows through into the wellbore.

* * * * *